US010842203B2

(12) United States Patent
Wood et al.

(10) Patent No.: US 10,842,203 B2
(45) Date of Patent: Nov. 24, 2020

(54) WATERFOWL HUNTING COAT WITH INTEGRATED MULTI-FUNCTIONAL POCKET SUITE AND METHODS OF USE FOR IMPROVED HUNTING EFFICIENCY, SAFETY, AND ENJOYMENT

(71) Applicant: Drake Waterfowl Systems, Olive Branch, MS (US)

(72) Inventors: Tate Wood, Olive Branch, MS (US); Bobby L. Windham, Jr., Olive Branch, MS (US); Jeff L. Jones, Olive Branch, MS (US)

(73) Assignee: DRAKE WATERFOWL SYSTEMS, Olive Branch, MS (US)

( * ) Notice: Subject to any disclaimer, the term of this patent is extended or adjusted under 35 U.S.C. 154(b) by 200 days.

(21) Appl. No.: 15/730,505

(22) Filed: Oct. 11, 2017

(65) Prior Publication Data

US 2019/0104775 A1 Apr. 11, 2019

(51) Int. Cl.
*A41D 13/00* (2006.01)
*A41D 3/00* (2006.01)
(Continued)

(52) U.S. Cl.
CPC ..... *A41D 13/0012* (2013.01); *A41D 3/00* (2013.01); *A41D 13/0007* (2013.01);
(Continued)

(58) Field of Classification Search
CPC ..... A41D 13/0012; A41D 2600/108; A41D 27/20; A41D 27/201; A41D 3/00;
(Continued)

(56) References Cited

U.S. PATENT DOCUMENTS 168,622 A * 10/1875 Daigre ..... A41D 13/0012 2/94
1,212,513 A 1/1917 Langerman
(Continued)

FOREIGN PATENT DOCUMENTS

FR 2473846 A1 * 7/1981 ..... A01K 97/00
FR 2588451 A1 * 4/1987 ..... A41D 13/0012

*Primary Examiner* — Amy Vanatta
(74) *Attorney, Agent, or Firm* — Hulsey, P.C.

(57) ABSTRACT

A waterfowl hunting coat includes a coat torso portion covering the torso of the hunter. An integrated waterfowl hunting pocket suite includes a plurality pockets positioned on the coat torso portion. The integrated waterfowl hunting pocket suite includes at least one shell pouch that has a flapless opening and is positioned on a lower portion of the coat torso portion for receiving shotgun shells and making the shotgun shells and other ammunition accessible to the hunter. An upper cargo pocket provides a side loading opening for storing and permitting ready access to items of the hunter other than shotgun shells. A lower cargo pocket includes a side loading opening for storing and permitting ready access to items of the hunter other than shotgun shells. A hand warmer pocket is positioned apart and away from the shell pouch, the upper cargo pocket, and the lower cargo pocket and for accepting the hand of the hunter by the hunter bending his elbow to an approximate 90-degree angle.

10 Claims, 7 Drawing Sheets

(51) Int. Cl.
*A41D 13/11* (2006.01)
*A41D 27/22* (2006.01)
*A42B 1/04* (2006.01)

(52) U.S. Cl.
CPC ..... *A41D 13/11* (2013.01); *A41D 13/1153* (2013.01); *A41D 27/22* (2013.01); *A42B 1/048* (2013.01); *A41D 2200/20* (2013.01); *A41D 2600/108* (2013.01)

(58) Field of Classification Search
CPC ..... A41D 1/04; A41D 13/0007; A41D 13/11; A41D 13/1153; A41D 2200/20; A41D 27/22; A41D 27/208; A41D 3/02; A41D 13/0015; A41D 2300/00; A41D 2600/106; A42B 1/048
USPC ..... 2/94
See application file for complete search history.

(56) References Cited

U.S. PATENT DOCUMENTS 1,572,517 A * 2/1926 Conover ..... A41D 13/0012 2/94
2,368,654 A 2/1945 Frank
2,437,223 A * 3/1948 Dutrow ..... A41D 13/01 2/94
2,598,143 A * 5/1952 Smith ..... A41D 13/0151 2/94
3,130,416 A * 4/1964 Mitchell ..... A41D 13/0012 2/79
3,193,842 A * 7/1965 Bell ..... A41D 27/20 2/94
3,529,307 A * 9/1970 Belson ..... A41D 13/0012 2/94
3,561,010 A * 2/1971 Little ..... A42B 1/045 2/173
4,106,121 A * 8/1978 Belson ..... A41D 13/0012 2/102
D261,070 S 10/1981 Pettibone
4,876,724 A * 10/1989 Suzuki ..... H04R 5/023 381/385
5,014,359 A * 5/1991 Hanson ..... A41D 13/0012 2/102
5,127,565 A 7/1992 Grant
5,247,707 A * 9/1993 Parker ..... A41D 13/0012 2/102
5,713,077 A * 2/1998 Humbrecht ..... A41D 13/1153 2/108
D392,439 S * 3/1998 Okoniewski ..... H04R 5/023 D2/828
5,738,046 A * 4/1998 Williams ..... A62B 35/0068 119/770
5,829,060 A * 11/1998 Falk ..... A41D 13/0012 2/102
5,852,828 A * 12/1998 Foster ..... A41D 13/0012 2/102
5,909,802 A * 6/1999 Puco ..... A45F 3/04 2/102
5,924,613 A * 7/1999 Johnson ..... A45F 5/02 2/94
6,119,269 A * 9/2000 Imler ..... A41D 13/0012 2/102
7,418,740 B2 * 9/2008 Anderson et al. ..... A41D 27/20 2/94
D633,692 S 3/2011 Lawrence
D638,200 S 5/2011 Gorson
D758,697 S 6/2016 Clark
D781,027 S 3/2017 Zheng
D812,858 S 3/2018 Lamprey
D836,299 S 12/2018 Lamprey
2003/0172431 A1 * 9/2003 Allen ..... A41D 13/0007 2/69
2004/0237169 A1 * 12/2004 Wood ..... A41D 13/0012 2/94
2010/0031415 A1 2/2010 Shadid
2018/0177248 A1 6/2018 Sneath
2018/0220757 A1 * 8/2018 Brundage ..... A45C 1/04
2019/0098948 A1 * 4/2019 Studinger ..... A41D 27/201

* cited by examiner

WATERFOWL HUNTING COAT WITH INTEGRATED MULTI-FUNCTIONAL POCKET SUITE AND METHODS OF USE FOR IMPROVED HUNTING EFFICIENCY, SAFETY, AND ENJOYMENT

FIELD OF THE DISCLOSURE

The present disclosure relates to a waterfowl hunting coat with an integrated multifunctional pocket suite for improved hunting efficiency, safety, and enjoyment. More particularly to a method and system for addressing the needs of a hunter in performing a variety of actions, including storing cargo or non-ammunition items for use during the hunt, dedicated storage of shotgun shells or other ammunition, and keeping the hunter dry and warm as he faces the elements in flooded timberlan, a lake, or out in a field to hunt ducks and other waterfowl.

BACKGROUND OF THE DISCLOSURE

In duck hunting, several needs arise as a hunter goes out into the hunting area that, if addressed, would make the hunting trip much more efficient, safer, and enjoyable. For example, a very popular product for the duck hunting sport is known as the "neck gator." The neck gator is a fleece product that a hunter may can pull over his head for warmth. The neck gator warms all the way from the neck to the hunter's eyes, serving as a face mask and sells for use as a standalone product.

A problem with the neck gator is that it is independent of hunter (i.e., generally not tethered or tied to the hunter) and can be lost. Once lost, the hunter loses the benefit of the neck gator in the cold duck-hunting environment. As a practical matter, the only place where the hunter may stow a neck gator is in his blind bag, i.e., is bag that he keeps in a duck blind. Unfortunately, the neck gator becomes just as one more thing in the blind bag for the hunter to carry. And the general principle in wilderness hunting is that the fewer things the hunter must carry in the blind bag, the better, as simplicity is essential for a successful and enjoyable hunt.

One of the problems in preparing for a duck hunt is that packing the hunter's blind bag is time consuming. Frequently, however, there is little time for a hunter to get ready for the hunt. The hunter may get too busy during the week leading up to the hunt and not stow everything he needs in his blind bag. For example, if a neck gator is remembered and stowed in the bag, its benefits are simply not available.

Waterfowl hunting coats include a detachable camouflage hood. Frequently when in the wilderness, the camouflage hoods can be lost upon being detached. Once lost, a significant part of the benefit of having the coat diminishes. There is a need for a way to retain or keep the removable hood so that it doesn't get lost, while also being able to the hood when it is not needed.

In waterfowl hunting, generally, there is the need for a boat to navigate the water where the hunting. When hunting in the wilderness for waterfowl, the combination of water, a motorboat, cold weather, guns and ammunition, can create a situation that requires safety equipment to prevent bodily injury. It is not uncommon that a person in a boat may fall outside the boat and into the water. During hunting, it is very frequent that the hunter will enter and exit the boat depending on the hunting opportunities that arise.

Generally, motor boat use in a waterfowl hunting boat, includes a kill switch that causes the engine to stop if the hunter leaves or falls from the boat. The kill switch includes a bungie cord that the hunter holds or tries to connect to something on his person. If the hunter pulls the bungie cord, the kill switch actuates to kill the motor and stop further boat movement. This protects the hunter from injury by the moving propeller, as well as prevents the boat from continuing motoring away from the hunter a distance that may be too far to swim. So, if the hunter is in the boat, as the boat travels to the duck blind or another location, if the hunter be separated or fall off the boat, he can safely swim to the boat to re-board and restart the engine.

To make the kill switch operate properly, the hunter must attach the bungie cord for the kill switch to something on his person. Often, the problem with the kill switch is just where to attach the kill switch so that it operates as intended.

Frequently, hunters simply wrap the kill switch around her wrist. But this is neither a desirable nor safe approach. This unduly limits the ability for the hunter to do the things for which he otherwise needs his hand in navigating and using the boat. It would be preferable to attach the kill switch to something else. But, this is not so simple out in the wilderness.

The above considerations are but a sampling of the problems facing a hunter as he seeks to enjoy duck hunting. If these challenges were successfully addressed, then the sport of waterfowl hunting could be significantly more efficient, safe, and enjoyable.

BRIEF SUMMARY OF THE DISCLOSURE

The disclosed subject matter provides waterfowl hunting coat with integrated multifunctional pocket suite and methods of use for improved hunting efficiency, safety, and enjoyment. According to one aspect of the present disclosure here is provided waterfowl hunting coat that includes a coat torso portion covering the torso of the hunter. Sleeves attach to said coat torso portion and cover the arms of the hunter. A collar connects with the coat torso portion and surrounds and provides weather protection for the neck region of the hunter. An integrated waterfowl hunting pocket suite includes a plurality pockets positioned on the coat torso portion. The plurality of pockets optimizes respective actions and satisfy needs of the hunter at different stages of a waterfowl hunt.

The integrated waterfowl hunting pocket suite includes at least one shell pouch that has a preferably flapless opening and is positioned on a lower portion of the coat torso portion for receiving shotgun shells and making the shotgun shells and other ammunition accessible to the hunter. The preferably flapless opening permits the hunter to access the contents of the shell pouch without the need to raise or move a flap. The shell pouch is dedicated essentially exclusively for storing and retrieving the shotgun shells and other ammunition. The shell pouch includes a plurality of closure means formed along the flapless opening for maintaining the at least one shell pouch in an essentially closed condition.

A combination pocket assembly includes an upper cargo pocket and duck call pouch on each side of the center of the coat's chest region. A lower cargo pocket includes a side loading opening for storing and permitting ready access to items of the hunter other than shotgun shells. A hand warmer pocket is positioned apart and away from the shell pouch, the upper cargo pocket, and the hand warmer pocket and is further positioned proximate a side seam on the coat torso portion for accepting the hand of the hunter by having the hunter raise the hand by bending his elbow to an approximate 90-degree angle for inserting into the hand warmer pocket for warming the hand.

The presently disclosed waterfowl hunting coat includes the technical advantage of a back pocket positioned on the back-torso portion. The back pocket expands across the back torso of the hunter. The back pocket is of a size to receive larger items that may not fit within the upper cargo or lower cargo pockets.

Another technical feature of the presently disclosed waterfowl hunting coat includes a plurality of shell loops positioned on the coat torso portion. Positioned beneath the lower cargo pocket at the waist region of the coat torso portion. The plurality of shell loops allows storing and making readily available shotgun shells for the hunter to use immediately during a hunt, if needed.

The waterfowl hunting coat further includes a kill switch "D"-ring associated with a bottom region of the coat torso for attaching to a kill switch bungie cord associated with boat motor kill switch.

A further technical advantage of the presently disclosed waterfowl hunting coat is a water-resistant drop-down seat for providing a surface on which the hunter may cover his posterior region for sit on a wet or cold area without water or cold penetrating to his posterior. The water-resistant drop-down seat associates with the back torso portion of the waterfowl hunting coat. The water-resistant drop-down seat may fold for being retained between the hunter's back and the back torso portion of the waterfowl hunting coat. The water-resistant drop-down seat may be removable for optional use.

The waterfowl hunting coat of the present disclosure also includes a carabiner strap mechanism for hanging the waterfowl hunting coat to a carabiner or hook structure, the carabiner strap mechanism including a carabiner, a buckled tether, a buckle, and lower tether portion, the lower tether portion firmly secured to the back-torso portion of the waterfowl hunting coat.

A further technical advantage of the waterfowl hunting coat includes a webbing hanging base upon which to attach the lower tether portion of the carabiner strap mechanism for firmly and strongly securing, the webbing hanging base. The webbing hanging base includes a sandwich structure of two webbing pads and there between the lower tether portion and the back torso portion of the waterfowl hunting coat. Webbing stitching attaches the sandwich structure onto an integral water-resistant structure on the back torso portion of the waterfowl hunting coat.

Another feature of the waterfowl hunting coat is a water-resistant pouch for containing the carabiner strap mechanism. The water-resistant pouch secures to the back-torso portion of the waterfowl hunting coat and includes a water-resistant pouch zipper for maintaining a watertight enclosure for the water-resistant pouch including a water-resistant zipper closure. The water-resistant pouch is configured to resist water penetrating through the waterfowl hunting coat back when the pouch zipper is opened.

A further technical feature of the presently disclosed waterfowl hunting coat includes a hood for protecting the head of the hunter from adverse weather. A collar includes a collar zipper for removing the hood when not needed. The hood further includes a hood zipper for zipper attachment of the hood to the waterfowl hunting coat with the collar zipper.

The waterfowl hunting coat further includes the aspect of a weather mask formed of a flexible knit material for stretching over the hunter's head and providing warmth and wind protection to the hunter. The weather mask attaches to the hood using a weather mask attachment stitching positioned proximate to the back of the hunter's head, and further making the weather mask always available for use when the hunter wears the hood.

Still further technical aspects and advantages of the presently disclosed waterfowl hunting coat for improved hunting efficiency, safety, and enjoyment will become apparent upon reading the technical description and considering the claims appearing below.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the FIGUREs and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form in order to avoid obscuring the concepts of the presently disclosed method and system.

In the present specification, an embodiment showing a singular component should not be considered limiting. Rather, the subject matter preferably encompasses other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present subject matter encompasses present and future known equivalents to the known components referred to herein by way of illustration.

Although the provides a description of waterfowl hunting coat with integrated multifunctional pocket suite and methods of use for improved hunting efficiency, safety, and enjoyment, it should be understood that the description is by way of example only and is not to be construed in a limiting sense. It is to be further understood, therefore, that numerous changes may arise in the details of the embodiments of this waterfowl hunting coat with integrated multifunctional pocket suite and methods of use for improved hunting efficiency, safety, and enjoyment. It is contemplated that all such changes and additional embodiments are within the spirit and true scope of this disclosed method and system as claimed below.

For purposes of the present disclosure herein appear references to water-resistant, water proof, breathable waterproof, windproof and breathable, and combinations of the above. The purpose of these terms is not be unduly limiting, but may include any material or construction wherein the purpose is to protect the user or hunter from the outside elements. This includes rain, snow, hail, wind, heat or other elements. So, where the term waterproof may be used, so too may the terms water-resistant, waterproof breathable, windproof and different combinations of similar terms. When such terms are used, the related subject matter is not to be unduly limited, but is to include all such embodiments as be clearly within the scope the disclosed and claimed subject matter.

Figure 1:
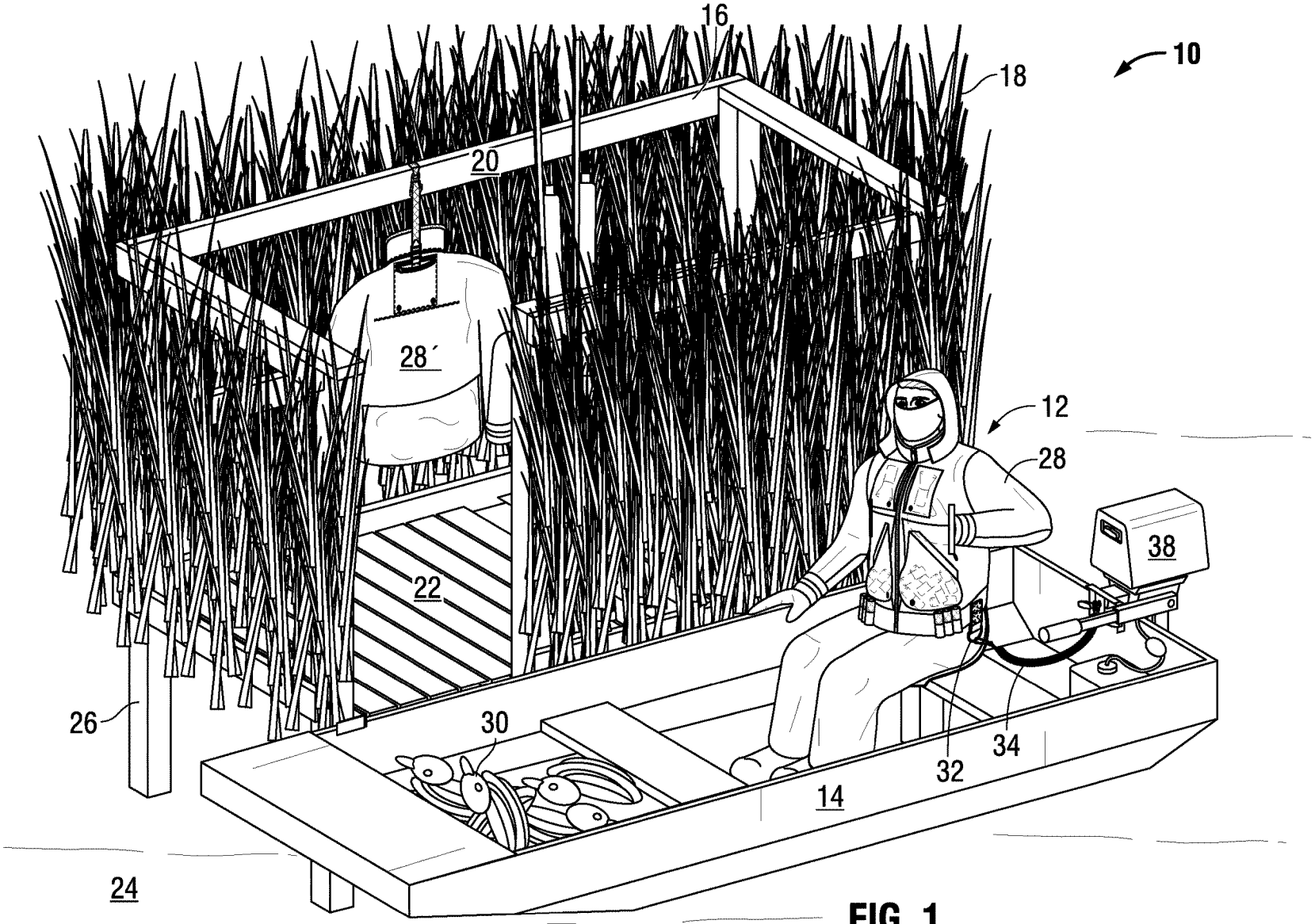
FIG. 1 shows duck hunting scenario wherein hunter may make use of the presently disclosed waterfowl hunting coat and it numerous innovations and technical advantages.

FIG. 1 shows duck hunting scenario 10 wherein hunter 12 may either operate from duck hunting boat 14 or duck blind 16. Duck blind 16 provides a space that may be surrounded by camouflage or marsh grass 18 and includes structural elements such as upper beam 20 and floor 22. Blind 16 may be supported above water 24 by beams 26. Waterfowl hunting coat 28 benefits hunter 12 both during use of both duck hunting boat 14 and duck blind 16. Duck hunting boat 14 provides the means by which hunter 12 may retrieve and collect water fowl 30 at various stages in the hunt. A duck hunting dog frequently accompanies the hunter to retrieve harvested waterfowl 30 to hunter 12. In essence, waterfowl hunting coat 28 may be considered to provide a new and novel integrated hunting system that will be more completely understood upon reading the description of the FIGUREs below to yield a hunt that is more efficient, safer, and more enjoyable for hunter 12.

Note that while duck hunting scenario 10 shows use of waterfowl hunting coat 28 with a duck blind 16 hunting scenario, wading, layout blind and other modes of waterfowl hunting may be similarly benefited by the inventive subject matter of the present disclosure. In general, while the presently disclosed subject matter pertains principally to the waterfowl hunting sport, a user may find waterfowl hunting coat 28 attractive for any sport wherein the sportsman or user desires protection from a cold, windy, or other outside environment in which the benefits of the waterfowl hunting coat 28 may be appreciated. Such outdoor environments are part of fishing, deer hunting, outdoor camping, and other sport or even professional participation in weather-rich or intensive situations where both warmth and the flexible pocket suite and other novel aspects of coat 28 are useful. As such, waterfowl hunting coat 28 may take the form of at least three embodiments. Once such embodiment appears in U.S. Design patent application Ser. No. 29/621,817, by the inventor hereof and entitled "HOODED SHORT CROPPED COAT," filed contemporaneously with the present application on Oct. 11, 2017. Other embodiments appear in U.S. Design patent application Ser. No. 29/621,819 by the inventors hereof and entitled "HOODED SHORT CROPPED COAT," filed contemporaneously with the present application on Oct. 11, 2017, and in U.S. Design patent application Ser. No. 29/621,821, by the inventors hereof and entitled "HOODED SHORT CROPPED COAT," filed contemporaneously with the present application on Oct. 11, 2017. All of these U.S. Design Patent Applications are expressly incorporated by reference, as fully and completely as though explicitly appearing herein.

Waterfowl hunting coat 28, for example, increases the safety of using duck hunting boat 14, as well as makes hunting within blind 16 more enjoyable. Waterfowl hunting coat 28 may be attached to structural beam 20 of duck blind 16. This permits hunter 12 to remove waterfowl hunting jack 28 to avoid its loss or becoming wet by falling to floor 22. The ability to hang or attach waterfowl hunting coat 28 to a structure is highly advantageous, because blind or field storage space is quite limited. The ability to hang waterfowl hunting coat 28 up and out of the way is a great convenience, particularly where there are not hooks or other ways to hang items.

Figure 2:
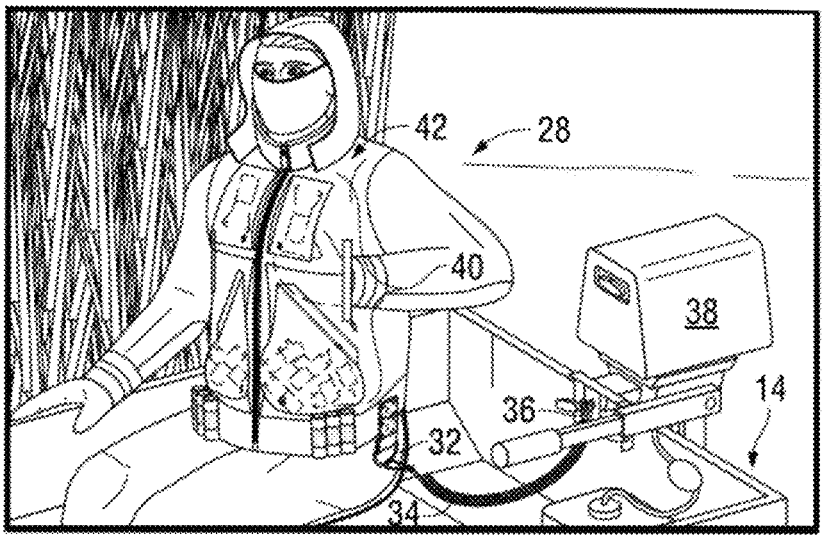
FIG. 2 illustrates the presently disclosed waterfowl hunting coat, as a hunter may wear the coat.
Figure 3:
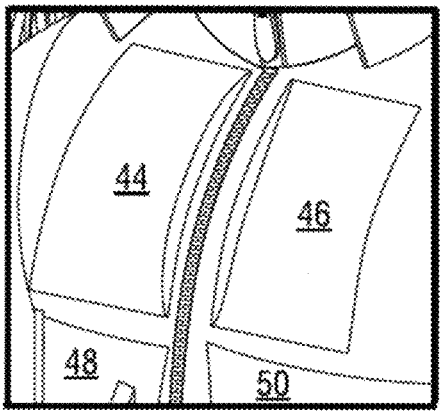
FIG. 3 depicts a close-up view of using the upper chest pocket assembly of the presently disclosed hunting coat pocket suite.
Figure 4:
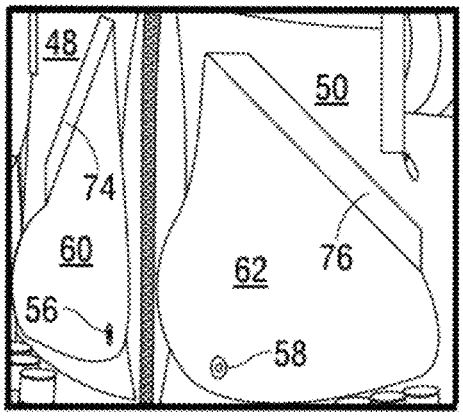
FIG. 4 highlights a close-up view of using the shotgun shell pouches of the presently disclosed hunting coat pocket suite.
Figure 5:
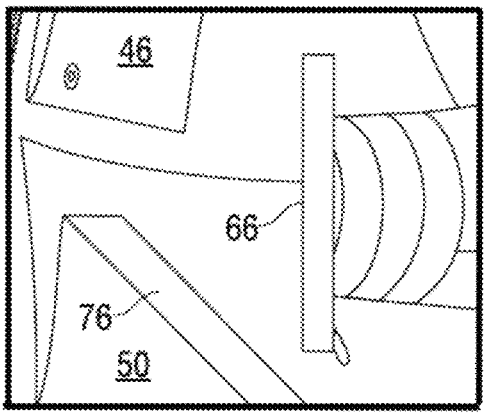
FIG. 5 shows a close-up view of using the hand warmer pockets of the presently disclosed hunting coat pocket suite.
Figure 6:
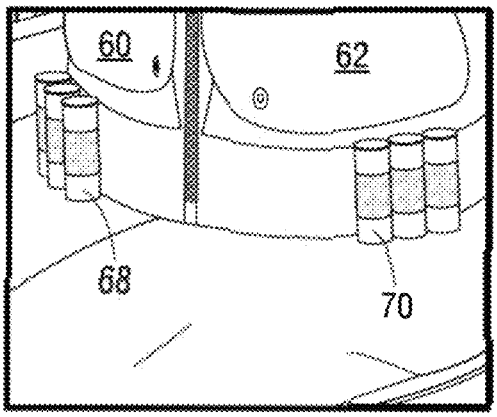
FIG. 6 focuses on a close-up view of using the shotgun shell loops of the presently disclosed hunting coat pocket suite.

FIG. 2 illustrates waterfowl hunting coat 28, as may be worn by hunter may wear the coat. In addition to showing how hunter 12 may wear waterfowl hunting coat 28, FIG. 2 also highlights the use of kill switch D-Ring 32. Kill switch D-ring protects hunter whenever hunter is in boat 14. By attaching kill switch bungie cord 34 to kill switch D-ring 32, kill switch 36 operates to turn off motor 38, in the event that hunter 12 falls out of boat 14. This permits hunter 12 to swim to boat 14 after falling out without concern of being injured by operation of motor or continuing on down the lake, beyond the swimming distance of hunter 12. Waterfowl hunting coat 28 of the present disclosure is especially designed with hunting pocket suite 40, which contemplates and satisfies specific needs of hunter 12 that arise during a duck or other waterfowl hunt. Hunting pocket suite 40 provides a set of pockets on waterfowl hunting coat front 42 that cooperate as a synergistic whole to make waterfowl hunting more efficient, safer, and more enjoyable.

With the presently disclosed embodiment of waterfowl hunting coat 28, kill switch D-ring 32 appears on the left side of hunter 12. This is due to the fact that outboard motors for use in waterfowl hunting often have their operation handle most accessible when hunter 12 sits on the right side facing the bow of boat 14. In other motor 38 configurations, it may be appropriate for kill switch D-ring 32 to be located on the right side of waterfowl hunting coat 28. For example, frequently fishing boats use motors with operation handles to the left of the fisherman. So, placing kill switch D-ring 32 on the right side of waterfowl hunting coat 28 may be preferred for such a situation. Whether on the right or left side of waterfowl hunting coat 28, each embodiment is clearly within the scope of the present disclosure.

FIGS. 3 through 6 provide close-up views of hunting pocket suite 40 as hunter 12 may use the uniquely associated and designed pockets thereof during a hunt. As FIGS. 3 through 6 disclose, hunting pocket suite 40 includes upper chest pocket assembly 44 (left) and 46 (right), FIG. 3; lower cargo pockets 48 (left) and 50 (right), beneath shell pouches 60 (left) and 62 (right), FIGS. 3 and 4; and hand warmer pocket 64 (right), FIG. 5; and shell loops 68 (right) and 70 (left), FIG. 6. Lower cargo pockets 48 and 50 appear behind and separate from shell pouches 60 and 62. Shell pouches 60 and 62 are positioned low and in front of lower cargo pockets 50 and 52 for only holding shotgun shells or other ammunition. Side seam hand warming pockets 64 and 66 (see, FIG. 7) are positioned higher and away from the shell pouches 60 and 62. All pockets here referenced appear more explicitly next in FIG. 7 and the associated description.

Figure 7:
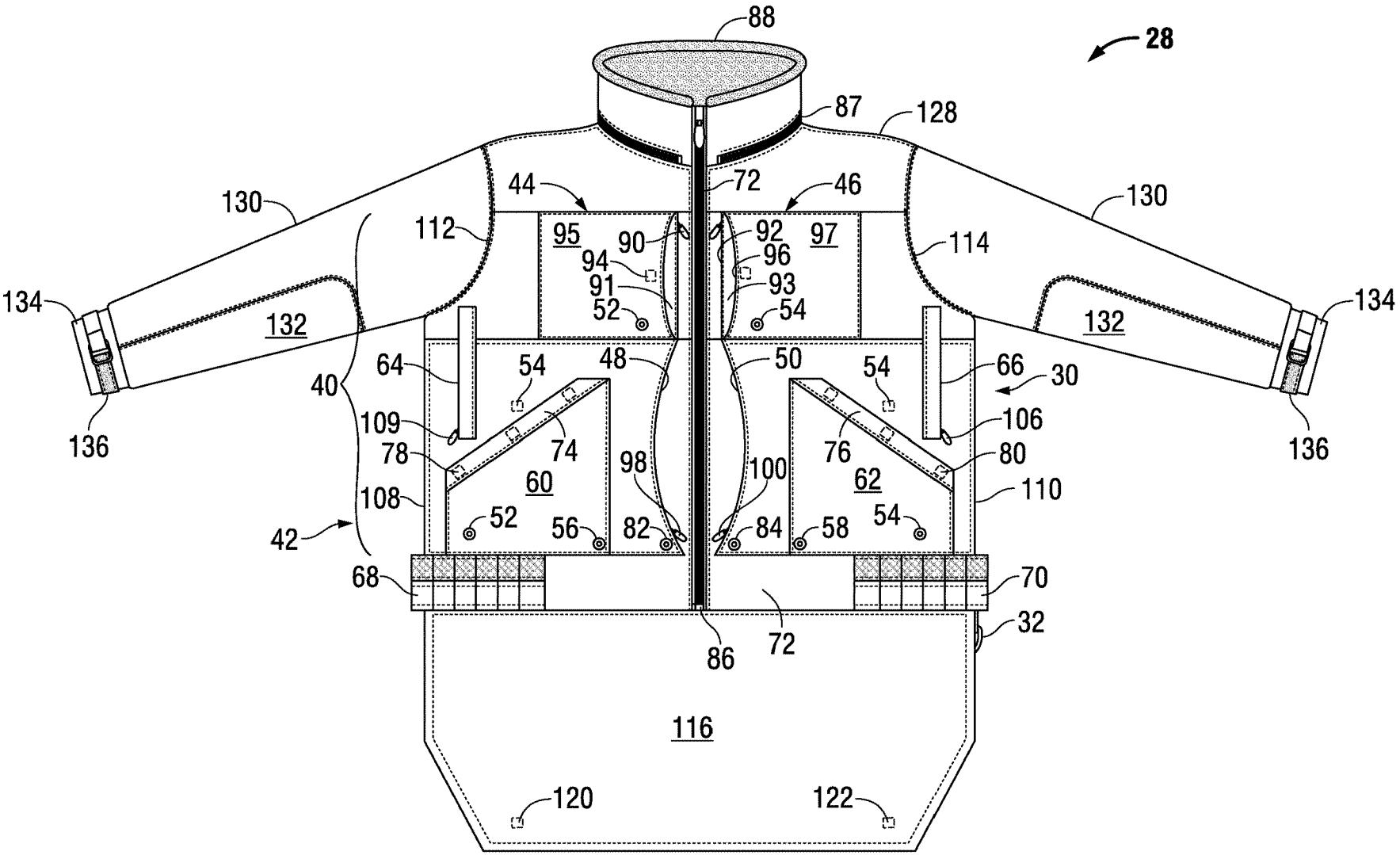
FIG. 7 shows waterfowl hunting coat front portion on which appear numerous novel aspects of the presently disclosed subject matter.

FIG. 7 shows waterfowl hunting coat front 42 on which of appears waterfowl hunting pocket suite 40. Waterfowl hunting pocket suit 40 may be considered an arrangement of coordinated waterfowl hunting scenario pockets that have been specifically designed with hunter 12 in mind to make essentially all stages of waterfowl hunting more efficient, safer, and more enjoyable.

Waterfowl hunting coat 28 provides a laminate coat having preferably three-layer fabrics. The laminate, as stated, may be waterproof, windproof or waterproof-windproof, or waterproof/windproof breathable or windproof breathable, or water-resistant, windproof, breathable and and all combinations of the above. However, a two-layer fabric may be acceptable for making the coat waterproof (but not breathable) and/or wind proofing and water resistant fabric. There are a multitude of desirable waterproof, water resistant, windproof, and other rugged fabrics that may be used for waterfowl hunting coat 28. However, whatever may be the choice of coat material, such material needs to be appropriate for the rigorous demands of waterfowl hunting and the various adverse weather conditions and external exposure considerations that face hunter 12.

For example, one embodiment of waterfowl hunting coat 28 uses a high-quality Guardian Elite 3 Layer Pro fabric on the garments with all features herein described. This includes use of Guardian Elite 3 Layer Pro fabric on the upper chest pocket assemblies 44 and 46, lower cargo pockets 48 and 50, Shell pouches 60 and 62, and hand warmer pockets 64 and 66. Another embodiment of waterfowl hunting coat 28 may use a different slightly less expensive two-layer fabric for a middle price point coat. All of these design and fabric considerations are clearly within the scope of the disclosed inventive subject matter.

Upper Chest Pocket Assemblies;

Waterfowl hunting coat front 42 is symmetric about coat zipper 86. Collar zipper 87 forms part of fleece lined collar 88. Upper chest pocket assemblies 44 and 46 are located at chest level and include pocket zippers 90 and 92 for providing access to upper cargo pockets 91 and 93, respectively. Closure magnets 94 and 96 provide access to and maintain in a generally closed position duck call pouches 95 and 97, respectively. That is, upper chest assemblies 44 and 46 form from two stacked pockets on each side; one set of zippered upper cargo pockets 91 and 93 on each chest level side and one set of magnet or other closure device accessed duck call pouches 95 and 97 on top of respective upper cargo pockets 91 and 93.

To meet the needs of hunter 12, upper chest pocket assembly 44 and 46 and lower cargo pockets 48 and 50 appear for easy access on the front of the coat. Then, on top, either sewn on top fabric or built into the body of waterfowl hunting coat 28. of lower cargo pockets 48 and 50 appear dedicated shell pouch 60 and 62. Dedicated shell pouches 60 and 62 mounted on top of lower cargo pockets 48 and 50 to eliminate confusion associated with shells being stowed in any cargo pockets 44 through 50. This is because, in part, shell pouches 60 and 62 are physically on the outside or stacked on top of lower cargo pockets 48 and 50.

Upper cargo pockets 91 and 93 are ideal for holding keys and items zippered because these items require secured, keys, phone, etc. that hunter 12 may want to access when wearing waders or when lower cargo pockets may otherwise not be easily accessible. Duck call pouches 95 and 97 are ideal for storing duck calls accessible through an auto closure so hunter 28 need not deal with a zipper or difficult-to-open closure. Lower cargo pockets 48 through 50 may receive gloves, chewing gum, tobacco, or whatever hunter 12 may desire to store therein. By storing cargo in cargo pockets 44 through 50, hunter 12 more intentionally stores shotgun shells or other ammunition for the hunt in dedicated shell pouches 60 and 62.

Lower Cargo Pockets:

Positioned below upper chest pocket assembly 44 and 46 appear lower cargo pockets 48 and 50. Lower cargo pockets 48 and 50 include pocket zippers 98 and 100. Shell pouches 60 and 62 include outer grommets 52 and 54 and inner grommet supports 56 and 58, respectively, for quick drainage of wind-driven rain or moisture that may accumulate in the nearby openings. Seam 102 may separate upper chest pocket assembly 44 and 46 from lower cargo pockets 48 and 50. Hand warmer pockets 64 and 66 include zippered openings 104 and 106 and are preferably positioned near side seams 108 and 110 below arm openings 112 and 114, respectively. However, other embodiments for hand warmer pocket 64 and 66 may be considered well within the scope of the presently disclosed inventive subject matter.

Positioning upper chest pocket assemblies 44 and 46 and lower cargo pockets 48 through 50 toward the center of the torso with side openings provides an easier way to access the cargo than the conventional horizontal flaps with the front, vertically loaded cargo pockets. Hunter 12 may slide something into cargo pockets 44 through 50 and have it ready for use without having to raise a flap on a vertically loaded cargo pocket. That is, hunter 12 may load something with into left upper cargo pocket 93 with his right hand using a more natural movement. Moreover, hunter 12 will more easily retrieve what he stowed in left upper cargo pocket 93, again using directly his right hand. Thus, the time and motion considerations of having the front-positioned center loading cargo and other pockets overcomes limitations associated with prior flap-opening vertically loaded pockets which may be located close to shell pockets and with openings located in same vicinity.

Hunter 12 may use a very natural motion with loading something with his right hand into upper left cargo pocket 46 or lower left cargo pocket 50, for example. During a hunt, hunter 12 needs to use and remove gloves for different tasks. The ability to easily retrieve gloves stowed in lower cargo pockets 48 and 50 and then stow them—right glove in left lower cargo pocket 50, left glove in right lower cargo pocket 48—makes the act of glove storage and retrieval considerably easier.

Dedicated Shell Pouches:

Dedicated shell pouches 60 and 62 are maintained in a closed position with the use of embedded shell pouch magnets 78 and 80 that permit easy opening for access to shells that shell pouches 60 and 62 contain. Note that magnets configurations may change according to the different embodiments of the present disclosure and still be within the scope of the presented inventive subject matter. For example, shell pouch magnets 78 and 80 show three embedded shell pouch magnets. However, one, two, or a different combination may work, as well. Shell pouch magnets 78 and 80 also establish a default or normal closed position for shell pouches 60 and 62, without the use of a zipper, button or other closing mechanism.

Dedicated shell pouches 60 and 62 provide a simple clean design that facilitates shotgun shell or ammunition storage and retrieval. Shell pouches 60 and 62 preferably include no flaps or zippers, thereby eliminating causes for snags or other complications in the use of shells. The placement of dedicated shell pouches 60 and 62 combined with side entry positioning of lower cargo pockets 48 and 50.

The last thing that hunter 12 wants to experience reaching when reaching into a waterfowl hunting coat 28 pocket is uncertainty as to what the pocket contains. This can have devastating effect during the hunt, and even pose a safety hazard for hunter 12. Hunter 12 desires to know that shell pouches 60 and 62 contain only shotgun shells. This is because hunter 12 typically tries to load his gun as quickly as he possibly can during a shooting session. To this end, hunter 12 desires to grab his shells and load his gun without confusion or delay.

Dedicated shell pouches 60 and 62 provide shell pouch openings 74 and 76, respectively, without flaps and an ergonomically friendly entry point on the front lower torso area, providing an ideal position for retrieving shells during the most active times of a hunt.

Shell pouch magnets 78 and 80 keep the entry area closed without the use of a flap or zipper. Closure means for the shell pouch may include a magnetic attachment assembly, fabric hook and loop fasteners or "Velcro," snaps, elastic band, zipper or other flapless means for causing the shell pouch to default or be easily placed in a closed state without the use of a pocket flap. Alternatively, the closure of shell pouch magnets 78 and 80 may be achieved through the use of a flap that tucks inside securely or snaps on the inside dedicated shell pouches 60 and 62 for holding them securely closed, but not interfering with use by hunter 12.

Side Hand Warmer Pockets:

Hand warmer pockets 64 and 66 are preferably fleece lined and positioned near the side seam of waterfowl hunting coat 28, which provides a convenient place for hunter 12 to position his hand for warming. Hand warmer pockets 64 and 66 are positioned a little higher than shell pouches 60 and 62 and towards the side of the hunter 12 body than in known coats and closer to the hunter's 12 heart, the main source of bodily warmth. When hunter 12 uses hand warmer pocket 64 and 66, hunter 12 reaches back a little farther and places his hands above the waist in a more intentional action.

Hand warmer pockets 64 and 66 are used principally when there is no action going on in the hunt, a time when sensing the cold frequently occurs. Thus, hand warmer pockets 64 and 66 provide a place to warm hands that is easily accessible at times when hunter 12 seeks warmth, but out of the way during shooting or other times of high action during the hunt. By moving the hand warming pockets 64 and 66 away from shell pouches 60 and 62, and moving cargo pockets to a different location on waterfowl hunting coat front 42, the only pockets that hunter 12 touches when he needs shotgun shells are shell pouches 60 and 62.

Another technical advantage of the present arrangement of upper chest pocket assemblies 44 and 46, lower cargo pockets 48 and 50, dedicated shell pouches 60 and 62, and hand warmer pockets 64 and 66 as here shown is that they are distributed across waterfowl hunting coat front 42. They are all not stacked one upon another. Here, only the lower cargo pockets 48 and 50 and dedicated shell pouches 60 and 62 are stacked, as are upper cargo pockets 91 and 93 and duck call pouches 95 and 97. This is a significant departure from prior coat designs and causes waterfowl hunting coat 28 to be less bulky and more comfortable for hunter 12. The sleek appearance that this design creates provides yet another attractive aspect of the presently disclosed subject matter.

Optional Shell Loops:

Shell loops 68 and 70 appearing FIG. 7 are exemplary. There may be a variety of shell loops 68 and 70 arrangements and numbers. Thus, depending on the desired use by hunter 12, may include, four, six or more shell loops. Shell loops 68 and 70 address the situation when the action gets fast and furious and hunter 12 may reduce his shell pouch 60 and 62 inventory down to two or fewer shells. Shell loops 68 and 70 serve as a backup place to keep extra shells.

Shell loops 68 and 70 are provided as an optional feature of the present disclosure. When combined with a dedicated "bulk" dedicated shell pouches 60 and 62 and having shell loops lower, less conveniently located on the coat, these are loops for holding "back up" shells. It is not uncommon for a hunter 12 to be unaware he has emptied his bulk shell pouch and find himself away from his shells. By having these on waterfowl hunting coat 28, hunter 12 always has backups, if his bulk storage is empty and he doesn't have immediate access to the shells. This small amount of additional ammunition may support hunter 12 in achieving more success during the hunt, by virtue of his knowing that he has a backup in the event that the busy activity of the hunt exceeds his original shell allocation in dedicated shell pouches 60 and 62.

Another possible use of the shell loops 68 and 70 could be for loading a different type of shell. For example, most duck hunting calls for 2¾" or 3-inch shells. In the event of an opportunity to harvest a goose arises during a hunt, a 3½-inch shell would be preferred. Thus, hunter 12 may load into shell loops 68 and 70 3½ inch shells to increase the likelihood of success in killing the goose during the duck hunt. However, the principal reason for shell loops 68 and 70 is for addressing the situation of hunter 12 being separated from his shell supply, depleting the shell supply in shell pouches 60 and 62 and yet having an opportunity to continue shooting as the opportunity may quickly be presented. By having available shells in shell loops 68 and 70, hunter 12 has the ability to achieve more and stay in the hunting activity. Note that the number of shell loops on waterfowl hunting coat 28 may vary according to the particular embodiment and specific purpose of the version of waterfowl hunting coat 28 that hunter 12 uses.

Figure 8:
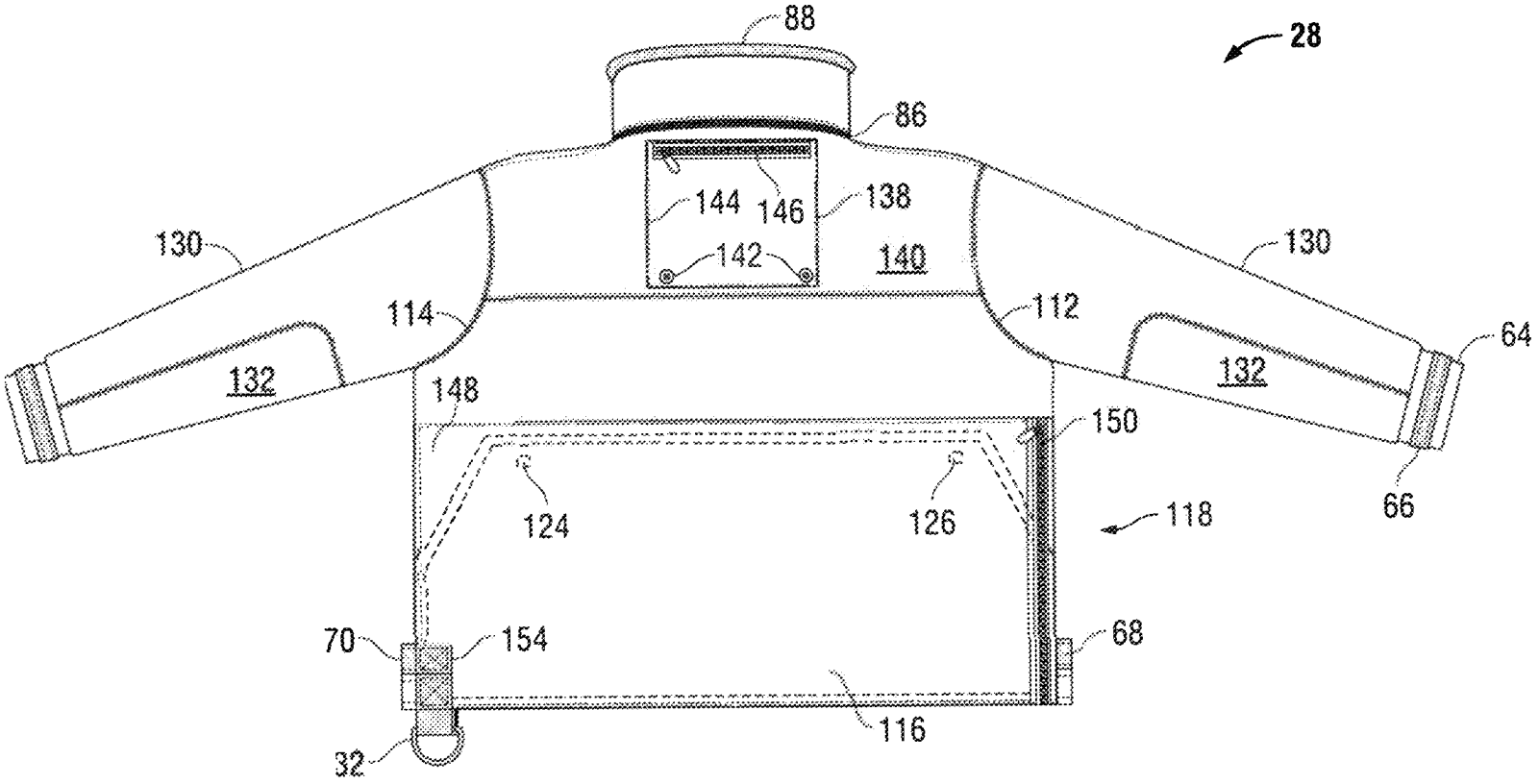
FIG. 8 shows waterfowl hunting coat back to illustrate further aspects of the presently disclosed novel subject matter.

Drop-Down Seat:

Appearing also in FIGS. 7 and 8 is water-resistant drop-down seat 116. Water-resistant drop-down seat 116 attaches or is an integral part of waterfowl hunting coat back 118. Water-resistant drop-down seat 116 includes seat attachment points 120 and 122 which position to mate with embedded coat attachment points 124 and 126 of the interior lining of waterfowl hunting coat back 118. Attachment points 120, 122, 124 and 126 may be magnetic attachment mechanisms, Velcro, or other means for securing drop-down seat 116 folds up into the inner back of water fowl hunting coat 28 and inside waterfowl hunting coat back 118. Providing a surface on which hunter 12 may cover his posterior region and sit on a wet, muddy or ice covered area. Water-resistant drop-down seat 116 may also be insulated, such as with closed cell foam or other materials for keeping water off the hunter's 12 rear, without necessarily being waterproof. In one embodiment, water-resistant drop-down seat 116 may be removeable.

Water-resistant drop-down seat 116 may appear with waterfowl hunting jack back in a variety of embodiments. Alternative embodiments of waterfowl hunting coat 28 include a short-cropped coat, such as appearing in FIGS. 7 and 8. This may also be referred to as a wading coat. A wading coat design for waterfowl hunting coat 28 benefits hunter 12 when hunting principally in flooded timber or marshes or wetlands.

Preferably, there are two lengths of coat for waterfowl hunting coat 28—a waist length coat and a parka length coat. A parka length coat comes down below the posterior of hunter 12, but not down to the knee. When hunter 12 sits down, such as in boat 14, he sits on waterfowl hunting coat 28 and will keep his pants dry. However, more frequently, hunter 12 will use waterfowl hunting coat 28 in the waist length configuration, as heretofore demonstrated. So, water-resistant drop-down seat 116 can provide the advantages of the parka length coat for keeping hunter 12 dry in boat 14, when the seat and the rest of the boat 14 interior may be wet. This dry seat hunter 12 experiences without paying the price of the longer length and excessive material of parka coat.

Water-resistant drop-down seat 116 also can be very advantageous when hunter 12 occupies a hunting pit. In a hunting pit, rain, snow, or just cold surfaces can require that hunter 12 protect himself or isolate from a cold seat or floor. The water-resistant drop-down seat 116 design extends protective fabric down to just above hunter's 12 knees and provides a significant amount of comfort during these weather exposures.

An attractive feature of water-resistant drop-down seat 116 includes the use of seat magnets 120 and 122 in association with embedded magnets 124 and 126 within waterfowl hunting coat back 118. Seat magnets 120 and 122 allow the water-resistant drop-down seat 116 to be stowed inside waterfowl hunting coat 28. There are no snaps or other alignment structures, necessary. Embedded magnets 124 and 126 and seat magnets 120 and 122 simply align with one another to magnetically catch water-resistant drop-down seat 116 within waterfowl hunting coat 28 liner.

Fleece Lined Collar and Sleeves:

FIG. 7 further shows that waterfowl hunting coat 28 includes fleece lined collar 88 attaching to shoulder piece 128 at waterfowl hunting coat front 42. Shoulder piece 128 is an part of waterfowl hunting coat 28 and attaches to sleeves 130. Sleeves 130 include reinforcing lower arm patches 132 for strength and durability. There are a number of ways to construct waterfowl hunting coat 28. Sleeves can be a part of the shoulder design and not necessarily be separate from the shoulders if cut and patterned this way. Moreover, cuffs may not be separately formed. At the end of sleeves 130 appears cuff 134 to which securing strap 136 attaches. Securing strap 136 helps by providing a weather and water-resistant seal at the end of sleeve 130.

Kill Switch "D"-Ring:

At the lower portion of waterfowl hunting coat back 50 appears kill switch "D"-ring 32 that webbing stitching base 154 secures to the outer water-resistant fabric of waterfowl hunting coat back 118. As used herein, the term "webbing" refers to a strong fabric woven as a flat strip or tube of varying width and fibers, often used in place of rope. It is a versatile component used in climbing, slacklining, furniture manufacturing, automobile safety, auto racing, towing, parachuting, military apparel, load securing, and many other fields. Nylon and polypropylene webbing has use with products like bags, backpacks, leashes, tie downs, and all the other similar uses. Polypropylene webbing provides a good option for handles, trim, binding and applications that need UV protection.

Polypropylene webbing is not dyed, but made by extruding colored polypropylene. Polypropylene Webbing characteristics include a resistance to bleeding, excellent UV protection & resistant to mildew, low water absorbance and positive buoyancy. Nylon webbing, in contrast, is a durable option for applications such as leashes, bridles, and handles. Nylon webbing, therefore, exhibits high breaking strength, low resistance to mildew, susceptibility to bleeding and fading with long term exposure to elements can cause bleeding and fading.

The present disclosure includes kill switch "D"-ring mechanism 32, which includes webbing attachment 154 formed of high tensile strength nylon or polyester webbing. High tensile nylon or polyester webbing is sewn to the outside water-resistant fabric of water-resistant hunting coat 28. Then, webbing attachment 154 is looped underneath edge 156. The result is webbing on both the outer fabric and inner fabric of waterfowl hunting coat back 118 at the point of attaching kill switch "D"-ring mechanism 32, with the three layers of fabric forming waterfowl hunting coat 28. There is, therefore, webbing 154 forms a "V" over edge 156 as a "sandwich" with material of waterfowl hunting coat back 118 and webbing stitching securing both sides of webbing 154 to waterfowl hunting coat back 118.

Attachment Mechanism Pouch:

FIG. 8 shows waterfowl hunting coat back 118 to illustrate further aspects of the presently disclosed novel subject matter. With reference to FIG. 8, waterfowl hunting back 118 includes water-resistant pouch 138 sewn onto back shoulder panel 140. Water-resistant pouch 138 includes drainage grommets 142 and heavy duty stitching 144 for securing water-resistant pouch 138 to waterfowl hunting coat 28. With water resistant zipper 146, a water-resistant enclosure exists within pouch 138.

Large Back Pocket:

Waterfowl hunting coat back 118 further includes back pocket 148 which provides a larger pocket accessible by way of water-resistant zipper 150. Back zipper pocket 148 provides a place for storage of cargo, waterfowl, and other larger items, as well as waterfowl hunting coat removable hood 152 (see FIGS. 14 and 15, below). When hunter 12 does anything that involves a flashlight or shells are other items, having back zipper pocket 148 can be very helpful.

Figure 9:
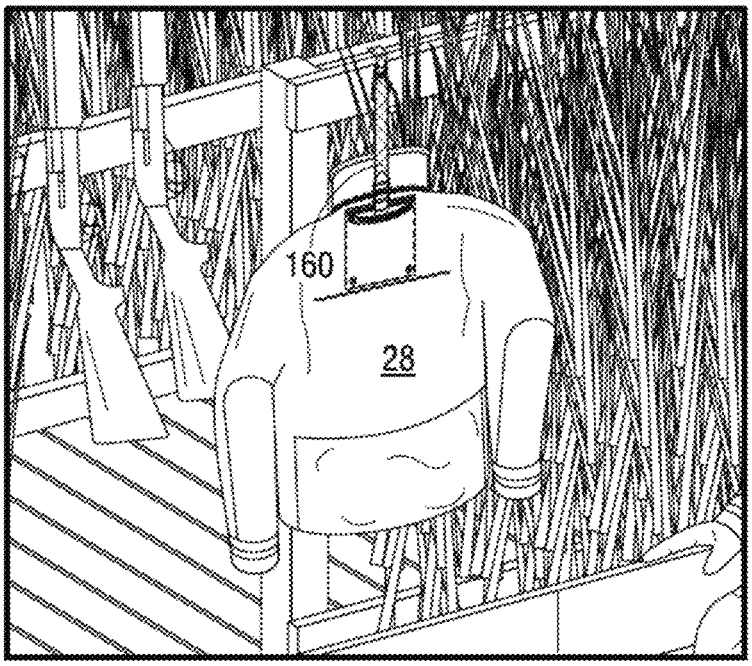
FIG. 9 depicts how a hunter may use the carabiner strap mechanism of the presently disclosed hunting coat.

Coat Hanging Attachment Mechanism:

FIG. 9 depicts how a hunter may use carabiner strap mechanism 160 of the presently disclosed waterfowl hunting coat 28. It is well known within the duck hunting community, that when hunter 12 needs clothes to keep him warm during cold times of the duck hunt, there are no clothes in the woods for him to find and to use. Thus, it is generally better for hunter 12 to carry with him too many clothes than to have to few. So, hunter 12 will typically take a coat the hunt, even when he may not need the coat, regardless of the temperature on the particular day. So, while the hunter 12 typically takes his coat, it's not unusual for infrequent for him to gets hot during the hunt and want to remove the coat. So, frequently hunter 12 will remove his coat, but he wants also to place the coat someplace where it will not be wet or lost.

Figure 10:
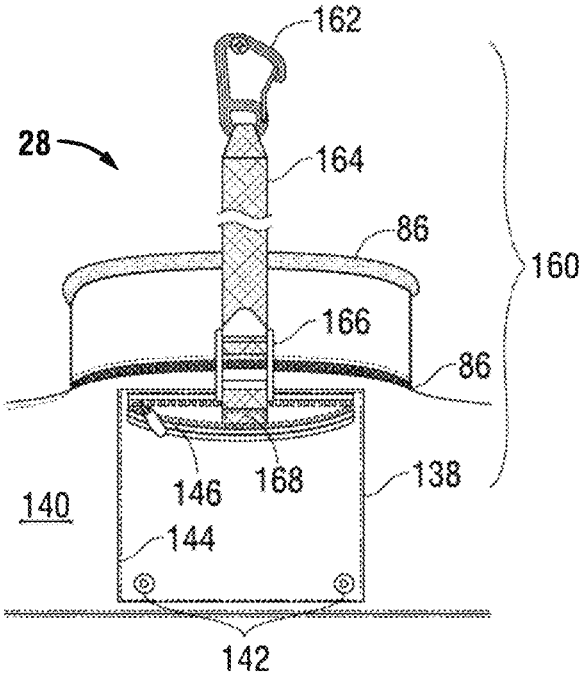
FIG. 10 shows an important novel aspect of waterfowl hunting coat carabiner or hook coat hanging mechanism.

Carabiner strap mechanism 160 of the present disclosure addresses the need of hunter 12 to have a safe and dry place waterfowl hunting coat 28. Carabiner strap mechanism 160 provides a tethered mechanism associated with the interior of waterfowl hunting coat 28. In FIG. 10, water-resistant pouch 138 includes carabiner 162, which attaches to buckled tether 164, as well as grommets 142 and stitches 144 for securing to water-resistance back shoulder pad 140. Buckled tether 164 includes buckle 166 which associates with tether lower portion 168. Tether lower portion 168 firmly and securely attaches to waterfowl hunting coat 28 using a webbing attachment, as described below. Thus, carabiner 162, buckled tether 164, buckle 166, and tethered lower portion 168, are secured within water-resistant pouch 138, and as a further explained below, cooperate to provide a heavy-duty carabiner strap mechanism 160 for hanging waterfowl hunting coat 28.

As referenced herein, the term "carabiner" is to be interpreted broadly and generally as to include a wide variety of specialized types of shackle or hanging mechanisms. This includes a metal loop with a spring-loaded gate to quickly and reversibly connect a belt to a structure. Types of carabiners within the scope of the present disclosure may include an asymmetric D-shape, a pear shape, an oval shape carabiner. Alternatively, a grappling hook device with multiple claws or flukes temporarily secure may be used, as well as other structures for providing the ability to hold the tether engaged with a rigid or strong flexible structure for holding the waterfowl hunting coat in a fixed position. This may even include webbing folded to form a type of hook.

Figure 11:
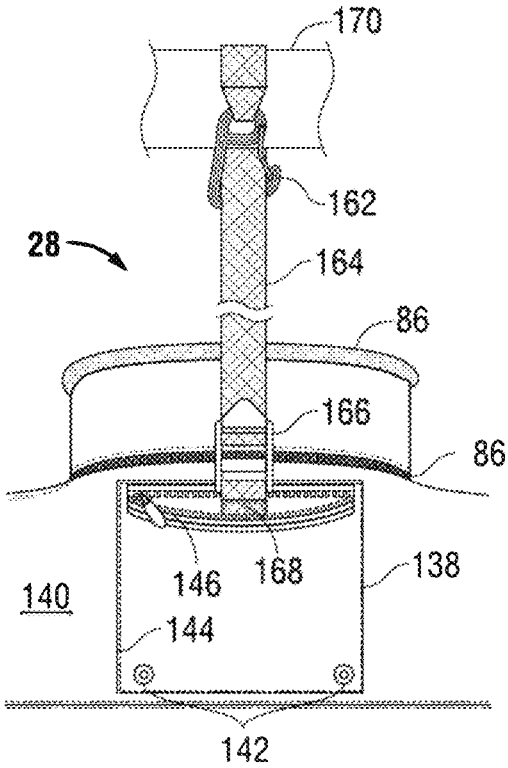
FIG. 11 shows an alternative use of the carabiner coat hanging mechanism of the present disclosure.

Referring to FIGS. 10 and 11, carabiner strap mechanism 160 permits hanging waterfowl hunting coat 28 in many different types of locations, including out in the forest, out in the water on a structural associated with a blind, and other places. Carabiner 162 may hook on a nail, a metal edge, or any structure on which the curved carabiner arm may make engagement. Buckled tether 164 provides a small and thin ribbon-like structure for looping around even a small limb, or wood board or metal tubing. By wrapping carabiner 162 around such a small limb and securing carabiner over buckled tether 164, carabiner strap mechanism 160 allows hunter 12 to make sure that waterfowl hunting coat is held in place, even by a limb that might not otherwise support or hold the coat, securely or at all. This flexibility improves significantly the options of hunter 12 to safely remove waterfowl hunting coat 28 to a dry location until he returns or otherwise desires to wear waterfowl hunting coat 28.

The combination of buckled tether 164 and carabiner 162 forming carabiner strap mechanism 160 permits adjusted attachment of waterfowl hunting coat 28 according to a wide variety of supporting and engaging structures. The ability to secure carabiner strap mechanism to a boat 14 frame, a pit or blind structure or tree limb greatly increases the attractiveness of waterfowl hunting coat 28.

Figure 12:
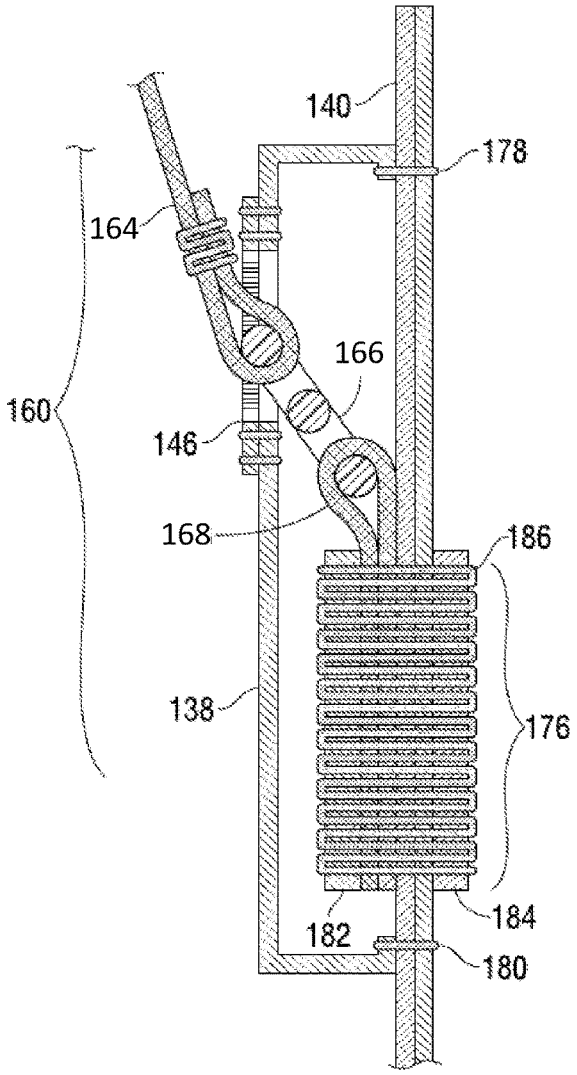
FIG. 12 illustrates the construction of the lower portion of the waterfowl coat hanging mechanism according to the present disclosure.

Coat Hanging Attachment Mechanism Pouch:

FIG. 12, in combination with FIGS. 10 and 11, illustrates the construction of the lower portion of carabiner strap mechanism 160 and water-resistant pouch 138 of waterfowl hunting coat 28. Water-resistant pouch 138 is specially designed to provide watertight and extremely strong hanging base for carabiner strap mechanism 160. That is, FIG. 12 illustrates the strength of the attachment for carabiner strap mechanism 160 as a constituent member of waterfowl hunting coat 28. In FIG. 12, water-resistant pouch 138 secures to water-resistant back shoulder panel 140 of waterfowl hunting coat 28. Stitches 178 and 180 at their respective top and bottom positions of water-resistant pouch 138 create a water-resistant enclosure designed to prevent rain from leaking through the webbing spots that puncture the coat when zippered closed with carabiner stowed. Water-resistant pouch 138 provides an enclosure that may fully contain carabiner strap mechanism 160. Thus, carabiner strap mechanism 160 can completely fit within water-resistant pouch 138, including carabiner 162, buckled tether 164, buckle 166 and tether lower portion 168. With pouch zipper 146 open, buckle 166, buckled tether 164, and carabiner 162 may extend out of water-resistant pouch 138. Tether lower portion 168 firmly secures within water-resistant pouch 138. The strength of lower tether portion 168 derives from the combination 176 of webbing patch 182 and webbing patch 184 that hold firmly tether lower portion 168 and coat outer material of back shoulder panel 122. Together, this creates a tough, strong, and rigid structure through the webbing stitching 186. Webbing stitching 186 passes through webbing material 184, back shoulder panel material 140, tether lower portion 168, and outer webbing segment 182. This construction provides a highly attractive weight bearing capability, in contrast to a limited weight-bearing ability that may result from sewing carabiner strap mechanism 160 to and outer panel only.

Figure 13:
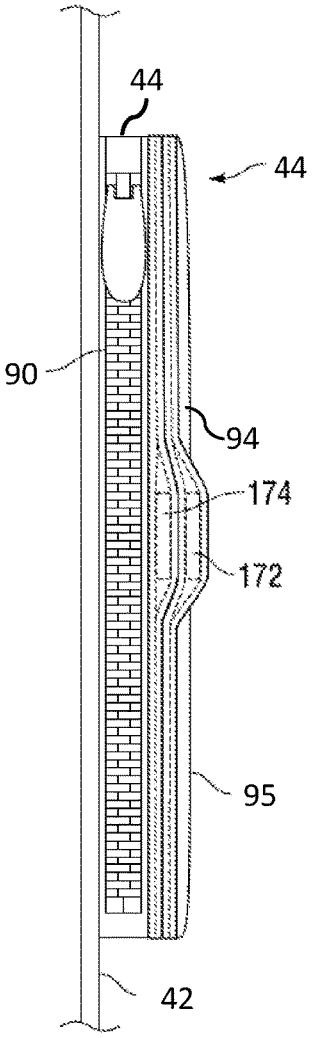
FIG. 13 shows the water-resistance zipper and closure magnets for the upper chest pocket assembly of the present disclosure.

Upper Chest Pocket Zipper & Closure Mechanism:

FIG. 13 provides a side view and shows that upper chest pocket assembly 44 attaches to waterfowl hunting coat 28 front panel 42. Upper chest pocket assembly 44 includes upper cargo pocket 91, which stacks atop duck call pouch 94. Water-resistant zipper 90 secures the contents of upper cargo pocket 91, while magnet closure 94 maintains duck call pouch 95 generally closed through magnet force of magnets 172 and 174. Note, as stated above, that, in place of magnets 172 and 174 forming magnet closure 94, the closure of duck call pouch 95 may be achieved using Velcro, a flexible stainless steel band, elastic or a variety of other flapless closure mechanisms.

Figure 14:
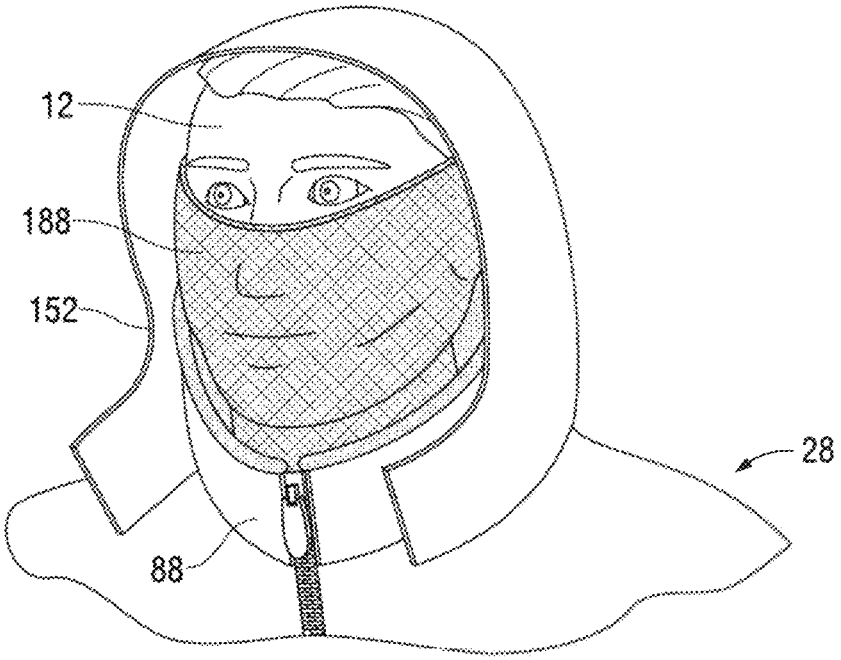
FIG. 14 illustrates a further aspect of the present disclosure including a waterfowl hunting coat hood and facemask of the disclosed subject matter.

Hood, Weather Mask & Back Pocket:

FIG. 14 illustrates a further aspect of the present disclosure including hood 152 that may attach to waterfowl hunting coat 28. Hood 152 includes weather mask 188 that keeps hunter 12 warm when the weather, including wind and rain/snow, is particularly cold and abrasive.

Figure 15:
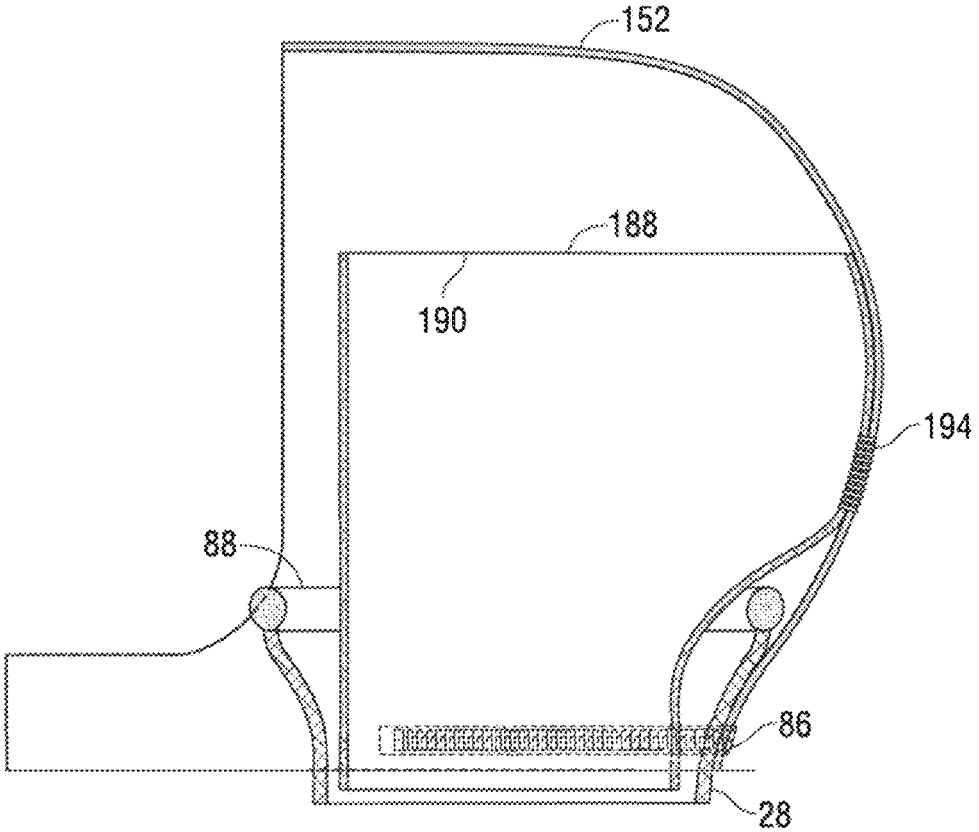
FIG. 15 shows how the presently disclosed mask forms an intricate part of the waterfowl hunting coat hood.

FIG. 15 shows how weather mask 188 forms an intricate part of hood 152. In particular, hood 152 attaches to waterfowl hunting coat 28 at collar zipper 87 (FIG. 7). As FIG. 15 depicts, collar 88 surrounds weather mask 188. By attaching hood 152 at collar zipper 87, zipping up fleece-lined collar 88, and placing weather mask 188 over his head, hunter 12 forms a completely weather protected envelope, with only the space between the upper edge 190 of weather mask 188 and top inner surface of hood 152 being exposed to the weather.

Hood 152 zips into waterfowl hunting coat 28 and may be detached as hunter 12 desires as the weather improves. In such event, hunter 12 simply unzips hood 132 at collar zipper 87. Waterfowl hunting coat 28 provides a most convenient location for hood 152 of back pocket 148 on waterfowl hunting coat back 118 (FIG. 8). By placing hood 152 in back pocket 148, hood 152 will not be lost. Moreover, hood 152 will provide a cushion effect as a result of its soft material being within back pocket 148. Moreover, by adding hood 152 to the contents of back pocket 148, hunter 12 may become warmer, even to the point of warming his kidney when out in the cold flooded timbers or otherwise in the field.

Weather mask 188 attaches to hood 152 at stitching 194. With weather mask 188 built in hunter 12 always has weather mask 188 with hood 152. Typically, when it's cold enough for hood 152, it's also cold enough for weather mask 188. With weather mask 188 sewn into hood 152, hood 152 works in unison with weather mask 188, when hunter 12 turns his head. That is, most hoods don't wear well with the head. Hunter 12 turns his head to look to the side, but the hood doesn't turn. By sewing weather mask 188 into hood 152, hood 152 of the present disclosure easily moves in unison with the head to turn with every head movement.

Another aspect of the present disclosure includes the synergy of hood 152 with back pocket 148. Back pocket 148 runs the width waterfowl hunting coat back 118. So, placing hood 152 in back pocket 148 provides padding or extra warmth on the back of the coat, which is where hunter 12 may become particularly cold when leaning back against a metal pit wall or wood blind or on the cold ground. Plus, with hood 152 in back pocket 148, it is completely out of the way of hunter 12, as he takes action during the hunt.

In light of the above, the present disclosure provides, a waterfowl hunting coat with integrated multifunctional pocket suite and methods of use for improved hunting efficiency, safety, and enjoyment.

All references, including publications, patent applications, and patents, cited herein are hereby incorporated by reference to the same extent as if each reference were individually and specifically indicated to be incorporated by reference and were set forth in its entirety herein.

The detailed description set forth herein in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments.

This detailed description of illustrative embodiments includes specific details for providing a thorough understanding of the presently disclosed subject matter. However, it will be apparent to those skilled in the art that the presently disclosed subject matter may be practiced without these specific details. In some instances, well-known structures and devices are shown in block diagram form in order to avoid obscuring the concepts of the presently disclosed method and system.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

What is claimed:

1. A waterfowl hunting coat for improving the efficiency, safety and enjoyment of a hunter during a waterfowl hunt, comprising:

a coat torso portion for covering the torso of the hunter;

sleeves attaching to said coat torso portion for covering the arms of the hunter, including a right sleeve for covering the right arm and a left sleeve for covering the left arm;

a collar attached to said coat torso portion for surrounding and providing weather protection for the neck region of the hunter;

an integrated waterfowl hunting pocket suite comprising a plurality of pockets positioned on said coat torso portion, said plurality of pockets formed for optimizing respective actions and satisfaction of needs of the hunter at different stages of a waterfowl hunt, said integrated waterfowl hunting pocket suite comprising:

at least one shell pouch comprising an opening and positioned on a lower portion of said coat torso portion for receiving shotgun shells and making said shotgun shells and other ammunition accessible to the hunter, said opening comprising an opening whereby the hunter may access the contents of said at least one shell pouch, said at least one shell pouch dedicated essentially exclusively for storing and retrieving said shotgun shells and other ammunition, and further comprising a plurality of closure means formed along a flapless opening for maintaining said at least one shell pouch in an essentially closed condition;

at least one upper pocket assembly comprising a side loading upper cargo pocket for storing and permitting ready access to items and self-closing duck call pouch for holding a duck call and related items;

at least one lower cargo pocket comprising a side loading opening for storing and permitting ready access to items of the hunter other than shotgun shells;

at least one hand warmer pocket positioned apart and away from said at least one shell pouch and said at least one upper cargo pocket, and further positioned proximate a side seam on said coat torso portion for accepting the hand of the hunter by having the hunter raise the hand by bending his elbow to an approximate 90-degree angle and inserting the hand into said at least one hand warmer pocket for warming the hand;

a coat zipper positioned on and separating two portions of said coat torso portion for closing the coat torso portion around the torso of said hunter; and a carabiner strap mechanism for hanging the waterfowl hunting coat to a hook or structure, said carabiner strap mechanism comprising a carabiner, a buckled tether, a buckle, and lower tether portion, said lower tether portion firmly secured to a back-torso portion of said waterfowl hunting coat; and a webbing hanging base upon which to attach said lower tether portion of said carabiner strap mechanism for firmly and strongly securing, said webbing hanging base comprising a combination of a first webbing patch and a second webbing patch that hold firmly said tether lower portion and a coat outer material of a back shoulder panel and webbing stitching sewn into an integral water-resistant structure on the back torso portion of said waterfowl hunting coat.

2. The waterfowl hunting coat of claim 1, further comprising a back pocket positioned on the back-torso portion of said waterfowl hunting coat, said back pocket configured to expand across the back torso of the hunter and further comprising a back-pocket zipper, said back pocket of a size to receive through said back pocket zipper larger items than may not fit within said at least one upper cargo pocket or said lower cargo pocket.

3. The waterfowl hunting coat of claim 1, further comprising a plurality of shell loops positioned on said coat torso portion beneath said at least one lower cargo pocket at a waist region of said coat torso portion, and further wherein said plurality of shell loops are positioned for storing and making readily available shotgun shells for the hunter to use immediately during a hunt.

4. The waterfowl hunting coat of claim 1, further comprising a kill switch "D"-ring attached to a bottom region of said coat torso portion for attaching to a kill switch bungie cord of a kill switch on a boat motor.

5. The waterfowl hunting coat of claim 1, further comprising a water-resistant drop-down seat for providing a surface on which the hunter may cover his posterior region and sit on a wet area without water penetrating to his posterior, said water-resistant drop-down seat attached to the back-torso portion of said waterfowl hunting coat, and further wherein said water-resistant drop-down seat may fold for being retained between the hunter's back and said back torso portion of said waterfowl hunting coat.

6. The waterfowl hunting coat of claim 1, further comprising a water-resistant pouch for containing said carabiner strap mechanism, said water-resistant pouch secured to said back torso portion of said waterfowl hunting coat and comprising a water-resistant pouch zipper for maintaining a watertight enclosure for said water-resistant pouch and a magnetic closing mechanism for closing said water-resistant pouch when said pouch zipper is opened.

7. The waterfowl hunting coat of claim 1, further comprising a hood, said hood for protecting the head of the hunter from adverse weather, and further wherein said collar comprises a collar zipper, said hood further comprising a hood zipper for zipper attachment of said hood to said waterfowl hunting coat with said collar zipper.

8. The waterfowl hunting coat of claim 1, further comprising a weather mask formed of a flexible knit material for stretching over the hunter's head and providing warmth and wind protection to the hunter.

9. The waterfowl hunting coat of claim 1, further comprising a weather mask, wherein said weather mask attaches to a hood using a weather mask attachment stitching configured for positioning proximate to the back of the hunter's head, and further making said weather mask always available for use when the hunter wears said hood.

10. The waterfowl hunting coat of claim 6, wherein said at least one shell pouch attaches to a front of said waterfowl hunting coat lower than the position of said hand warmer pocket for allowing immediate access to shells at a location that is more readily accessed than said hand warmer pocket.

* * * * *